US007279960B1

(12) United States Patent
Lee

(10) Patent No.: US 7,279,960 B1
(45) Date of Patent: Oct. 9, 2007

(54) REFERENCE VOLTAGE GENERATION USING COMPENSATION CURRENT METHOD

(75) Inventor: Bumha Lee, Pleasanton, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 116 days.

(21) Appl. No.: 11/215,174

(22) Filed: Aug. 30, 2005

(51) Int. Cl.
*G05F 1/10* (2006.01)

(52) U.S. Cl. ..... 327/538; 327/74

(58) Field of Classification Search ..... None
See application file for complete search history.

(56) References Cited

U.S. PATENT DOCUMENTS 4,039,859 A * 8/1977 Horninger ..... 327/3
6,069,520 A * 5/2000 Yamamoto et al. ..... 327/538
6,091,285 A * 7/2000 Fujiwara ..... 327/539
6,091,346 A * 7/2000 Muresan et al. ..... 341/56
6,518,898 B1 * 2/2003 Choksi ..... 341/118
6,885,236 B2 * 4/2005 Vorenkamp ..... 327/540
6,936,998 B2 * 8/2005 Cho ..... 323/280
6,963,298 B2 * 11/2005 Otsuka et al. ..... 341/155
6,985,027 B2 * 1/2006 Yabe ..... 327/541
7,009,545 B2 * 3/2006 Cho et al. ..... 341/155
7,102,424 B2 * 9/2006 Vorenkamp ..... 327/540
2003/0043066 A1 * 3/2003 Otsuka et al. ..... 341/158

OTHER PUBLICATIONS

Robert C. Taft et al., "A 1.8-V 1.6-GSample/s 8-b Self-Calibrating Folding ADC With 7.26 ENOB at Nyquist Frequency," *2004 IEEE*, Dec. 12, 2004 (9 pgs).

* cited by examiner

*Primary Examiner*—Tuan T. Lam
*Assistant Examiner*—William Hernandez
(74) *Attorney, Agent, or Firm*—Brett A. Hertzberg; Merchant & Gould PC

(57) ABSTRACT

A reference voltage generator that may be useful in analog-to-digital converter (ADC) circuits includes compensation for errors such as from non-ideal considerations such as semiconductor processing variations, mismatch errors, temperature gradients, and parasitic effects. The compensation method employs a correction current that is provided to the reference voltage generator to adjust the delay time and stability of the resulting reference voltage or voltages.

20 Claims, 6 Drawing Sheets

REFERENCE VOLTAGE GENERATION USING COMPENSATION CURRENT METHOD

FIELD OF THE INVENTION

The present disclosure generally relates to reference voltage generators that may be useful in analog-to-digital converter (ADC) circuits. More particularly, the present disclosure relates to a reference voltage generator that includes compensation for errors such as from semiconductor processing non-ideal effects. The compensation method employs a correction current method for adjusting the reference voltages for improved accuracy.

BACKGROUND

Voltage reference circuits are important in a wide-variety of applications including analog-to-digital conversion, sensor circuits, signal processing circuits, to name a few. For example, an analog-to-digital converter (ADC) circuit is arranged to receive an analog input signal and convert it into a digital code by comparing (e.g., sometimes repeatedly comparing) the analog input signal to the reference voltage. Depending on the architecture of the ADC circuit, the accuracy in the resulting digital code may be largely dependent on the accuracy of the reference voltage.

ADCs may employ a wide variety of architectures, such as the integrating, successive approximation, flash, and the delta-sigma architectures. Recently, the pipelined analog-to-digital converter (ADC) has become a popular ADC architecture for use in high-speed applications such as CCD imaging, ultrasonic medical imaging, digital video, and communication technologies such as cable modems and fast Ethernet. Pipelined ADCs are typically chosen because of their high accuracy, high throughput rate, and low power consumption. Moreover, the pipeline architecture generally provides better performance for a given power and semiconductor die area than other ADC architectures.

An example of a conventional pipelined ADC (100) is shown in FIG. 1A. As shown in the figure, the conventional pipelined ADC (100) includes an array of N gain stages. Each of the gain stages is connected in series to the previous gain stage. Each gain stage is also connected to a decoder logic circuit (not shown).

Each pipeline gain stage has a multiplying digital-to-analog converter (MDAC) circuit that includes a sample-and-hold amplifier (SHA), a sub-ADC circuit (k-bit ADC), a digital-to-analog converter (k-bit DAC), a summer (+), and a gain stage ($A_V$). The MDAC is arranged to receive an input signal ($V_{INPUT}$) and store the input signal with the sample-and-hold amplifier (SHA). The sub-ADC generates a corresponding k-bit digital code for the stored input level and then the digital code is converted back to the analog domain through the digital-to-analog converter (DAC). The sampled input signal from the SHA is subtracted from the output of the DAC by the summer, and then multiplied by $2^k$ via the gain stage ($A_V$), where k is the resolution of MDAC.

The residue voltage ($V_{RESIDUE}$) from the first gain stage (e.g., stage 1) becomes the analog input voltage to the next gain stage (e.g., stage 2) of the pipeline. That is, $V_{INPUT}(2) = V_{RESIDUE}(1)$. The residue voltages ($V_{RES}(i)$) continue through the various pipeline of gain stages (1–N), resulting in a series of digital coefficient (e.g., $D_i$) from the output of each k-bit ADC from each MDAC.

FIG. 1B is a graph that illustrates an ideal residue voltage in a pipeline ADC system. In this figure, the input voltage ($V_{INPUT}$) is provided along the x-axis and the resulting residue voltage ($V_{RESIDUE}$) is provided along the y-axis. The output residue voltage ($V_{RESIDUE}$) from each MDAC pipeline stage is generated by the following transfer function: $V_{RESIDUE}=V_{INPUT}*2^i-V_{REF}*D_i$, where i is the stage number of the MDAC, $D_i$ is digital code output from the $i^{th}$ stage DAC from the sub-ADC, and $V_{REF}$ is the corresponding reference signal.

The internal reference voltage ($V_{REF}$) for the sub-ADC is sometimes generated as a pair of reference voltages. For example, $V_{REFP}$ and $V_{REFN}$ are positive and negative reference voltages for the k-bit ADC, where $2*(V_{REFP}-V_{REFN})$ is the peak-to-peak range of the ADC, as illustrated in FIG. 1B.

BRIEF DESCRIPTION OF THE DRAWINGS

Non-limiting and non-exhaustive embodiments are described with reference to the following drawings.

DETAILED DESCRIPTION

Figure 1A:
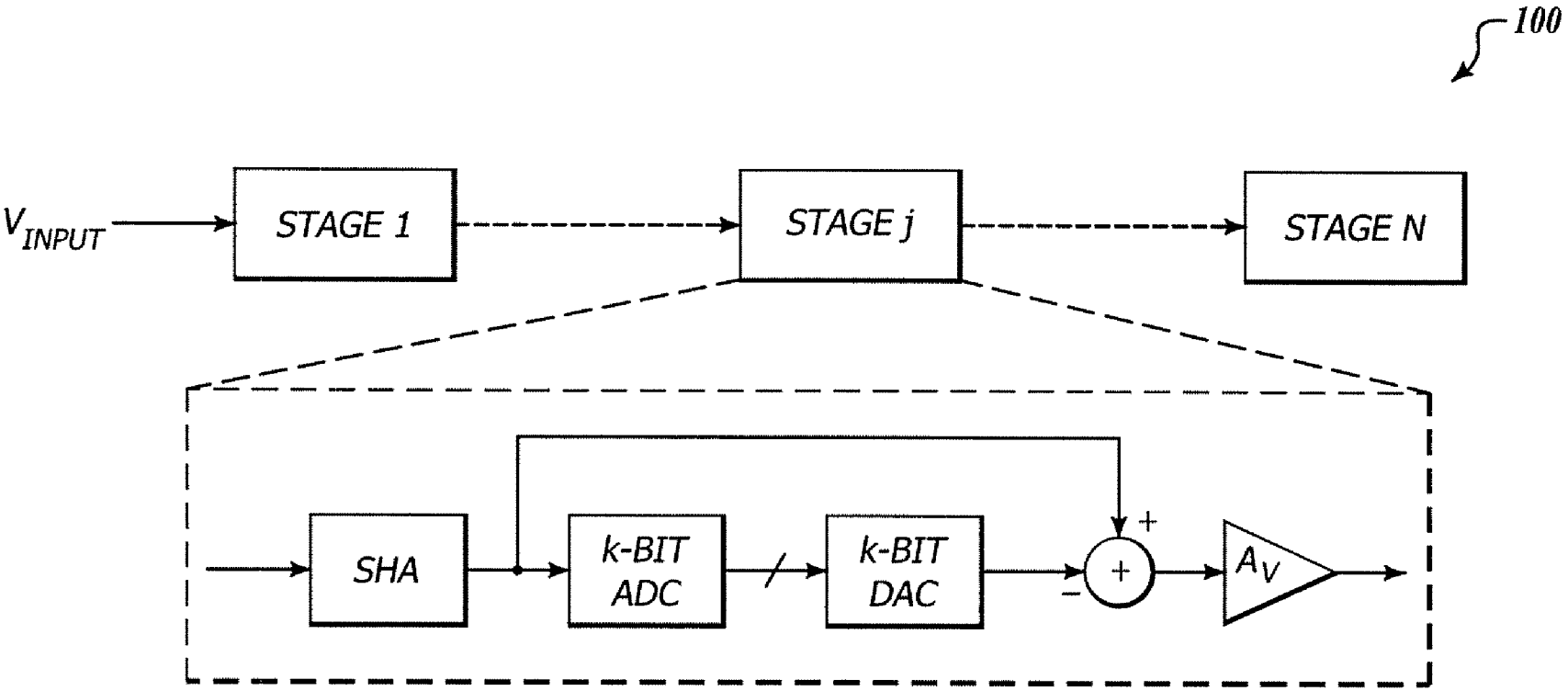
FIG. 1A (PRIOR ART)
FIG. 1A illustrates a schematic block diagram of a pipelined analog-to-digital converter (ADC).

Various embodiments will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for use of the terms. The meaning of "a," "an," and "the" may include reference to both the singular and the plural. The meaning of "in" may include "in" and "on." The term "connected" may mean a direct electrical, electro-magnetic, mechanical, logical, or other connection between the items connected, without any electrical, mechanical, logical or other intermediary therebetween. The term "coupled" can mean a direct connection between items, an indirect connection through one or more intermediaries, or communication between items in a manner that may not constitute a connection. The term "circuit" can mean a single component or a plurality of components, active and/or passive, discrete or integrated, that are coupled together to provide a desired function. The term "signal" can mean at least one current, voltage, charge, data, or other such identifiable quantity.

Briefly stated, the present disclosure generally relates to a reference voltage generator that may be useful in analog-to-digital converter (ADC) circuits. More particularly, the present disclosure relates to a reference voltage generator that includes compensation for errors such as from non-ideal effects such as from semiconductor processing variations, mismatch errors, temperature gradients, and parasitic effects. The compensation method employs a correction current that is provided to the reference voltage generator to adjust the delay time and stability of the resulting reference voltage or voltages.

General Comments

Modern applications are demanding higher performance from voltage reference circuits such as might be used in an analog-to-digital converter (ADC) circuits. The requirements for a modern ADC include high resolutions with high operating speeds such as might be required in IF sampling communication systems, where limited bandwidth may be available. Once in the digital domain, digital signal processing (DSP) functions can be performed with improved noise immunity, lower power dissipation, and improved immunity from temperature and power-supply variations compared to that found in the analog domain. Pipeline style ADC circuits are often selected for such communication system type applications since they have high resolution and high throughput rates. Example pipeline style ADC circuits include sub-ranging ADC circuits, two-step ADC circuits, and other similar architectures.

An example pipeline ADC consists of a set of cascaded pipeline gain stage circuits (see e.g., FIG. 1A). As described previously, each MDAC in a pipeline stage requires one or more reference voltages in order to carry out the analog to digital conversion process. The present disclosure contemplates past and present designs and identifies problems associated with the reference voltage generator that impair performance of the ADC. The present disclosure, with reference to the various figures that follow, will address such problems and offer a solution that improves the overall performance of the resulting ADC.

Evaluation of Reference Voltage Generator with Non-Ideal Effects

Figure 2A:
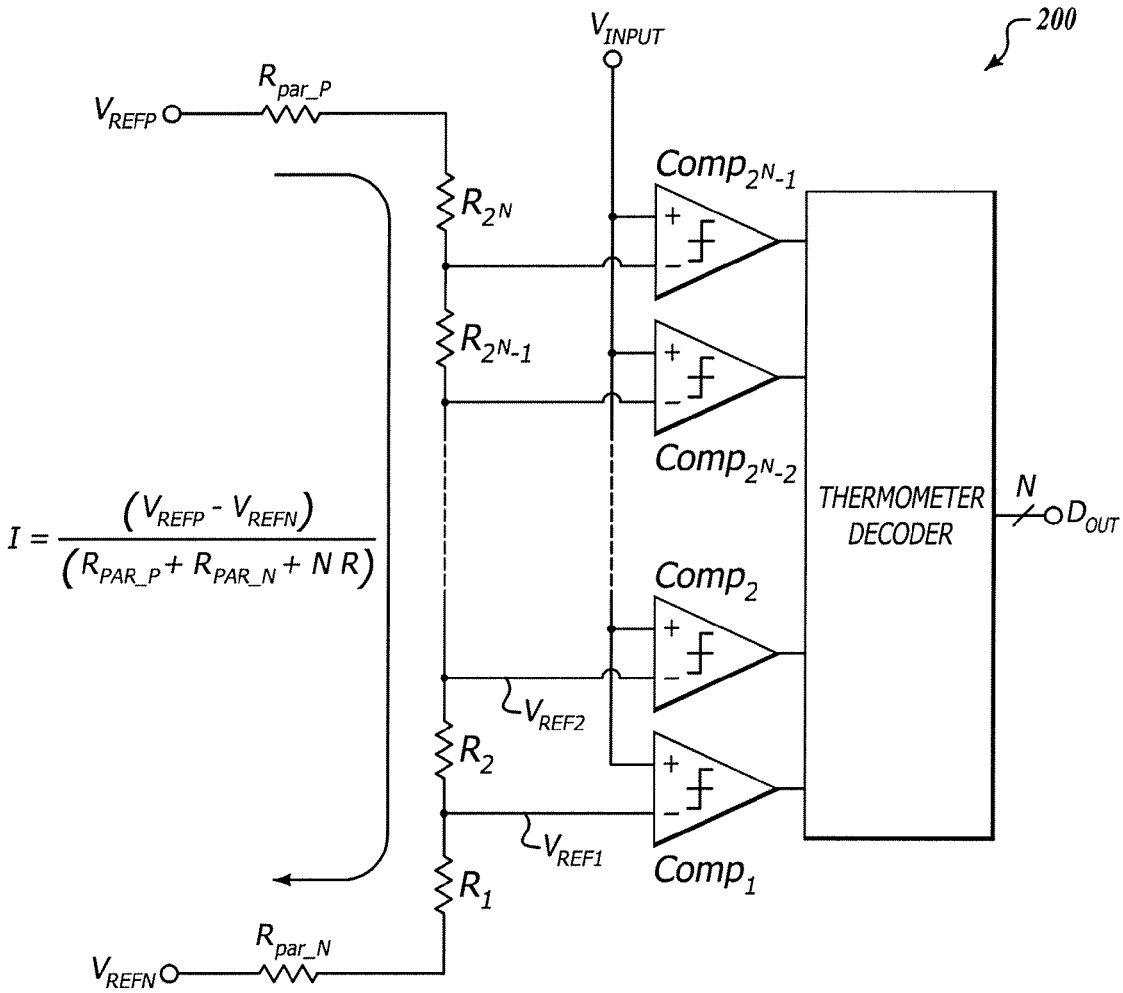
FIG. 2A illustrates a schematic diagram of a reference voltage generator that is configured for operation in an ADC system according to the present disclosure.
Figure 2A:
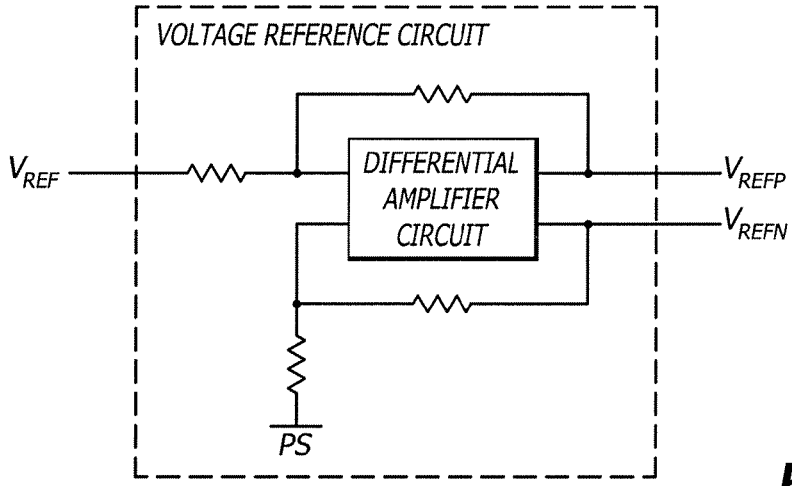

FIG. 2A illustrates a schematic diagram of a reference voltage generator that is configured for operation in an ADC system according to the present disclosure FIG. 2A illustrates a schematic diagram of a reference voltage generator circuit (200) that is configured for operation in an ADC. The circuit (200) includes resistors ($R_1$–$R_2^N$), a bank of comparators ($COMP_1 \ldots COMP_{2-1}^N$), a thermometer decoder logic block, and parasitic resistors $R_{PAR_P}$ and $R_{PAR_N}$.

Each comparator in the bank of comparators ($COMP_1 \ldots COMP_{2-1}^N$) is arranged to compare the input voltage ($V_{INPUT}$) to a different reference voltage. For example, a first comparator circuit ($COMP_1$) is arranged to compare the input voltage ($V_{INPUT}$) to a first reference voltage ($V_{REF1}$), while a second comparator circuit ($COMP_2$) is arranged to compare the input voltage ($V_{INPUT}$) to a second reference voltage ($V_{REF2}$). The resulting outputs from all of the comparators are combined by the thermometer decoder logic block to provide an N-bit digital output ($D_{OUT}$).

Resistors $R_1$ through $R_2^N$ are arranged as a series coupled voltage divider network to provide a series of different reference voltages (e.g., $V_{REF1}$, $V_{REF2}$, . . . ) for each of the comparators. For this example circuit, a pair of input reference voltages is provided (i.e., by a voltage reference circuit) across the resistors as $V_{REFP}$ and $V_{REFN}$, yielding an effective peak-to-peak input range of $V_{REFP}$–$V_{REFN}$ for the ADC. The common nodes between each of the resistors form tap-points in voltage divider network, yielding the different reference voltages (e.g., $V_{REF1}$, $V_{REF2}$, . . . ) for each respective comparator circuit.

The voltage reference circuit is arranged to provide the first reference voltage ($V_{REFP}$) and the second reference voltage ($V_{REFN}$) in response to an input reference voltage ($V_{REF}$) as illustrated. The voltage reference circuit can be a band-gap reference, a regulated voltage reference, a high-speed voltage reference, a filter capacitor, or any combination thereof. One example voltage reference circuit includes a differential amplifier circuit with two outputs and two inputs, where a first resistor circuit is coupled between the first output and the first input, a second resistor circuit is coupled between the second output and the second input, a third resistor is coupled between the first input and the input reference voltage ($V_{REF}$), and a fourth resistor is coupled between the second input and a power supply terminal (e.g., GND). For this example the first output of the differential amplifier circuit provides $V_{REFP}$, while the second output of the differential amplifier circuit provides $V_{REFN}$.

The first parasitic resistor ($R_{PAR_P}$) is coupled between a first one of the input reference voltages (e.g., $V_{REFP}$) and one side of the series coupled resistor array (e.g., resistor $R_2^N$). The second parasitic resistor ($R_{PAR_N}$) is coupled between a second one of the input reference voltages (e.g., $V_{REFN}$) and the other side of the series coupled resistor array (e.g., resistor $R_1$). The parasitic resistances $R_{PAR_P}$ and $R_{PAR_N}$ are provided to illustrate non-ideal effects in the resistor divider network. In reality, such resistances may be provided by metal traces on a circuit board, metal traces in an integrated circuit, lead frame connections, bonding wire connections, or any other appropriate connection between the input voltages and the resistor divider network. Although only illustrated as parasitic resistors in FIG. 2A, other non-ideal effects may include parasitic capacitances, inductances, and other non-ideal sources of error.

The parasitic resistance between the input voltages and the resistor divider network provides a source of error in the resulting reference voltages. In one example, the resistor array consists of N equally valued resistors (R) that are coupled together in series, yielding a total resistance of N*R. For this example, the current flowing through the reference voltage divider is expected to be:

$$I_{IDEAL}=(V_{REFP}-V_{REFN})/N*R \quad \text{(Eq. 1)}$$

The current flow yields through each resistor in the array, in this example, yields equal step sizes that are given by $V_{STEP}$=I*R. Substituting Eq. 1 into this yields:

$$V_{STEP_IDEAL}=(V_{REFP}-V_{REFN})/N \quad \text{(Eq. 2)}$$

The presence of the parasitic resistors in the circuit changes the overall current flow through the resistor array to:

$$I_{NON_IDEAL}=(V_{REFP}-V_{REFN})/(R_{PAR_P}+R_{PAR_N}+N*R) \quad \text{(Eq. 3)}$$

Although the step size between the reference voltages is still given by I*R, the step size is now different from the ideal step size of equation 2. Instead the step size is given as:

$$V_{STEP_NON_IDEAL}=R*I_{NON_IDEAL}$$

or $$V_{STEP_NON_IDEAL}=(V_{REFP}-V_{REFN})/[N+(R_{PAR_P}+R_{PAR_N})/R] \quad \text{(Eq. 4)}$$

Substituting the term: $R_{PAR}=R_{PAR_P}+R_{PAR_N}$ yields:

$$V_{STEP_NON_IDEAL}=(V_{REFP}-V_{REFN})/[N+(R_{PAR}/R)] \quad \text{(Eq. 5)}$$

The net result is that an error term is introduced such that $$V_{STEP_NON_IDEAL}=V_{STEP_IDEAL}-V_{ERROR} \quad \text{(Eq. 6)}$$

Solving for the error term:

$$V_{ERROR}=V_{STEP_IDEAL}-V_{STEP_NON_IDEAL}$$

$$V_{ERROR}=(V_{REFP}-V_{REFN})\ \{[1/N]-(1/[N+R_{PAR}/R])\}$$

$$V_{ERROR}=[(V_{REFP}-V_{REFN})/N]*\{1-(N/[N+(R_{PAR}/R)])\}$$

$$V_{ERROR}=V_{STEP_IDEAL}*[1-(N/[N+R_{PAR}/R])]$$

$$V_{ERROR}=V_{STEP_IDEAL}*[(N+R_{PAR}/R])-N]/[N+R_{PAR}/R]$$

$$V_{ERROR}=V_{STEP_IDEAL}*R_{PAR}/(R_{PAR}+N*R) \quad \text{(Eq. 7)}$$

When $N*R>>R_{PAR}$, the error term can be is simplified as:

$$V_{ERROR}=V_{STEP_IDEAL}*R_{PAR}/(N*R) \quad \text{(Eq. 8)}$$

The net result is that the error term $V_{ERROR}$ is determined by the total parasitic resistance ($R_{PAR_P}+R_{PAR_N}$), the resistance value of the unit sized resistors (R), in this example, and the number (N) of unit sized resistors in the array.

As can be observed by Eq. 8, high values for N*R relative to $R_{PAR}$ reduces the error that is contributed to the reference voltages. The internal reference voltages for the sub-ADC are generated by the resistor array as described above. When the resolution of the sub-ADC and the operating frequency increase, the unit resistor ($R=R_1=R_2^N$) should be decreased and the resulting voltage drop across the parasitic resistors ($R_{P1}$, $R_{P2}$) will increase due to the increased current flow. In other words, the decreasing values of the unit resistors result in an increased impact of the parasitic resistances on the reference voltages. In a practical implementation, it may not be possible to reduce the parasitic resistance sufficient to eliminate errors.

Figure 2B:
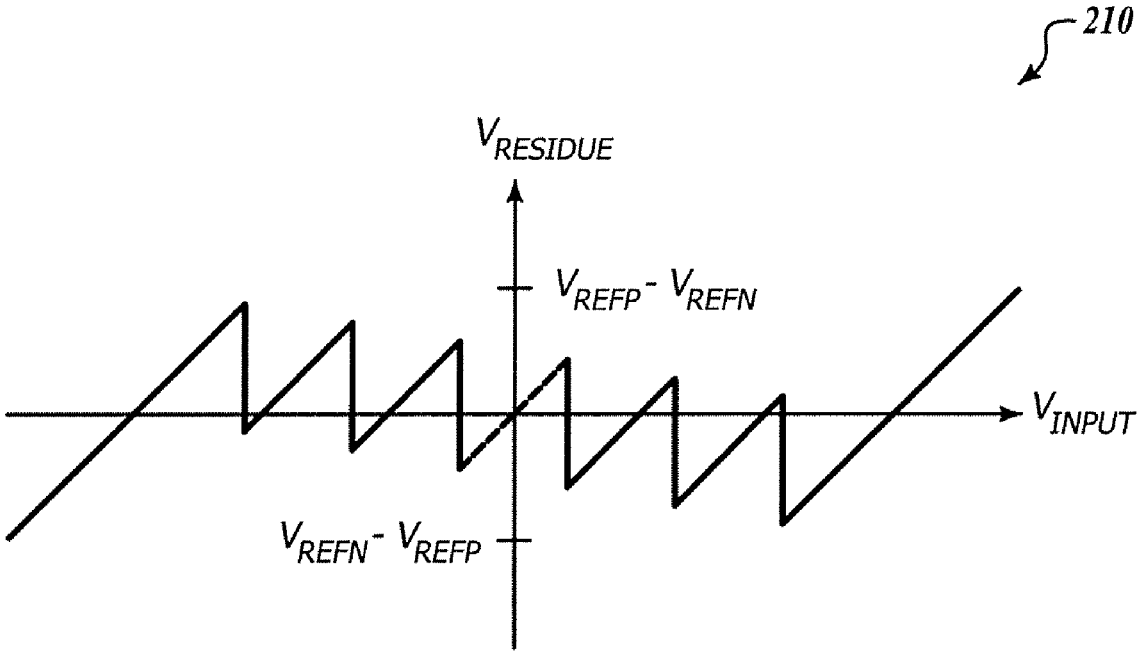
FIG. 2B illustrates a graph of a residue associated with the ADC system of FIG. 2A, including non-ideal effects according to the present disclosure.

FIG. 2B illustrates a graph of a residue associated with the ADC system of FIG. 2A, including non-ideal effects according to the present disclosure. The residue curve of the 1st MDAC includes the IR voltage drop due to the parasitic resistances described previously above. The comparator tripping point is compressed down to the center so that the residue departs from the ideal curve as shown in the figure, reducing the comparator's offset margin. When the unit resistor size becomes smaller at higher operating frequency for smaller time constant, the parasitic metal resistance should be reduced by increasing the width of the interconnect (e.g., the metal) to prevent the systematic comparator tripping point shifting. This will result in increased die area, as well as increasing noise coupling from the substrate to the reference voltage, as well as increasing the parasitic capacitances on the reference voltages. Smaller parasitic capacitance on the reference voltage path is preferred for increased speed.

Reference Voltage Generator with Current Compensation

Figure 3:
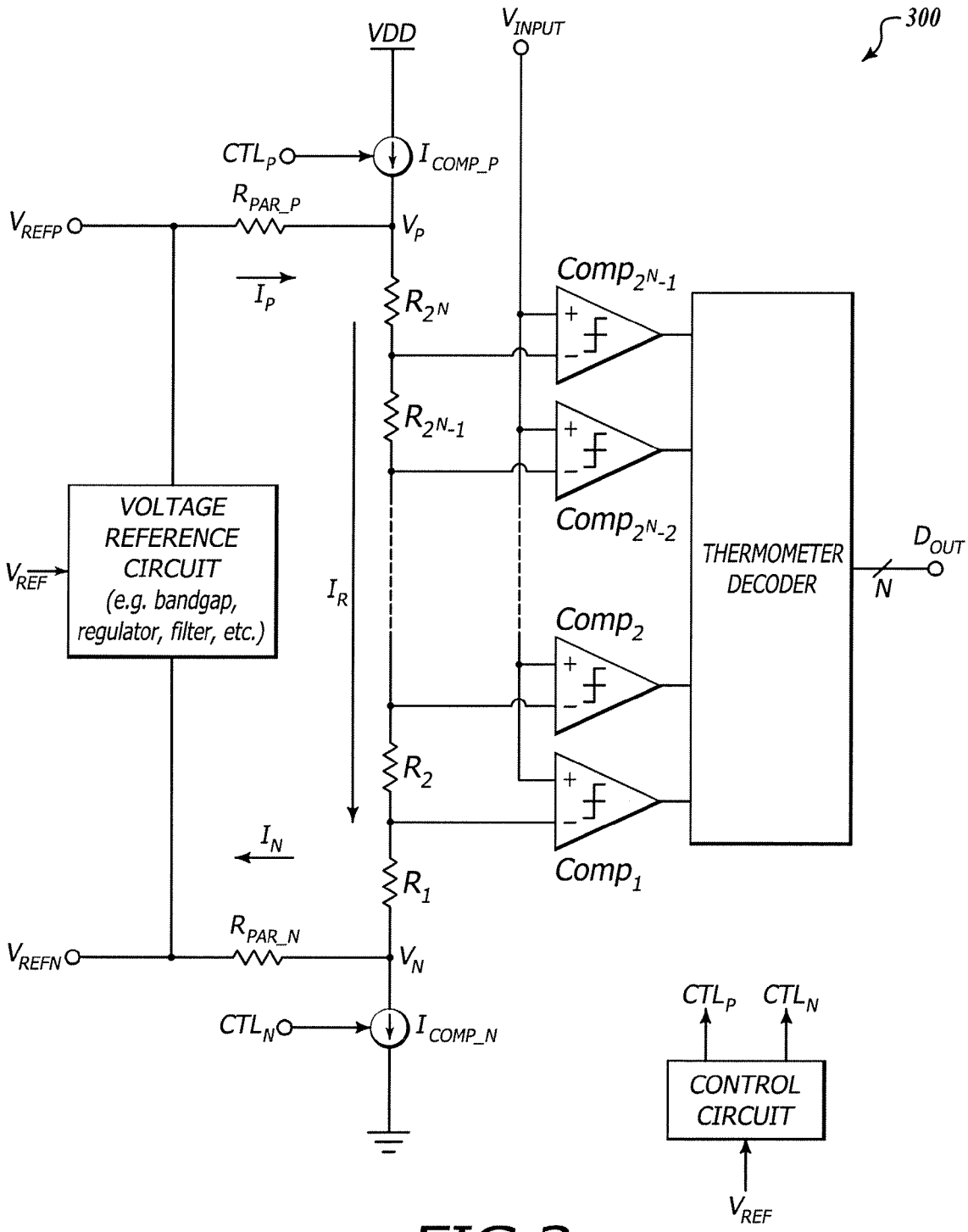
FIG. 3 illustrates a schematic diagram of another reference voltage generator that is configured for operation in an ADC system according to the present disclosure.

FIG. 3 illustrates a schematic diagram of another reference voltage generator circuit (300) that is configured for operation in an ADC system according to the present disclosure. Circuit 300 is substantially the same as circuit 200, with the addition of controlled current sources $I_{COMP_P}$ and $I_{COMP_N}$, and a compensation control circuit.

The compensated reference voltage generator circuit (300) includes two controlled current sources ($I_{COMP_P}$ and $I_{COMP_N}$). Controlled current source $I_{COMP_P}$ is responsive to control signal $CTL_P$, while controlled current source $I_{COMP_N}$ is responsive to control signal $CTL_N$. The compensation control circuit is arranged to provide control signals $CTL_P$ and $CTL_N$. Resistors $R_1$ through $R_2^N$ collectively form a series coupled resistor array in substantially the same way as that previously described with respect to FIG. 2A. The bank of comparators and thermometer decoder circuit block also function in substantially the same way as that previously described with respect to FIG. 2A.

Controlled current source $I_{COMP_P}$ is coupled to the $V_{REFP}$ pad via parasitic resistor $R_{PAR_P}$, while controlled current source $I_{COMP_N}$ is coupled to the $V_{REFN}$ pad via parasitic resistor $R_{PAR_N}$. Resistor $R_1$ through $R_2^N$ are series coupled between the controlled current sources ($I_{COMP_P}$ and $I_{COMP_N}$).

The compensated reference circuit (300) is arranged to provide a set of reference voltages. The reference voltages are provided by the array of series coupled resistor circuits, where each reference voltage corresponds to a different tap-point in the series circuit. Each of the voltages is provided as input to a respective one of the comparators, while the other inputs to the comparators are commonly coupled to the input voltage ($V_{INPUT}$) such that the comparator bank operates as a flash-type thermometer decoder. For example, the tap point for comparator circuit $COMP_1$ corresponds to the common-node for resistor circuits $R_1$ and $R_2$, while the tap-point for comparator circuit $COMP_{2-1}^N$ corresponds to the common-node for resistors circuits $R_2^N$ and $R_{2-1}^N$. The thermometer decoder logic block is arranged to provide a multi-bit digital output code ($D_{OUT}$) that is determined based on the output states of all of the comparator circuits.

Accurate reference voltages for the sub-ADC are generated when a constant current is flowing through the resistor array. However, errors in the accuracy of the current will cause errors in the voltage reference, and thus adversely effect the application such as the ADC conversion process. Each comparator presents a capacitive load at the respective tap-point in the resistor array. $V_{REFP}$ and $V_{REFN}$ are provided as high-speed voltage sources. $R_{PAR_P}$ and $R_{PAR_N}$ represent parasitic resistances such as from finite dimensioned routing in the circuit.

When currents $I_{COMP_P}$ and $I_{COMP_N}$ are perfectly matched with the resistor array, there is no DC current flowing through the parasitic resistors ($R_{PAR_P}$ and $R_{PAR_N}$), $V_P$ is equal to $V_{REFP}$, and $V_N$ is equal to $V_{REFN}$. However, during high-speed operation, switching transients, noise, and other non-ideal conditions in the circuit result in an AC current flowing from the source of the $V_{REFP}$ and $V_{REFN}$ input reference voltages through the parasitic resistances. Moreover, there is always a finite mismatch between current sources due to variations in processing, temperature gradients in the circuit, as well as other non-idealities.

The settling-time for each comparator circuit is a finite quantity. The voltage reference needs to provide a stable input to the comparator so that any uncertainty in the decision from each comparator is quickly resolved. Notably, the input impedance of each comparator is a complex impedance due to the input capacitance (i.e., a parasitic capacitance and/or a physical capacitance in the comparator circuit). The input capacitance of the comparators and the finite resistance from the resistor array results in a finite RC time-constant that can delay the stability in the reference voltages for each of the comparators.

The controlled current sources ($I_{COMP_P}$ and $I_{COMP_N}$) may be intentionally mismatched through their respective control signals (i.e., $CTL_P$ and $CTL_N$) to compensate for errors from the various parasitic circuit characteristics (e.g., parasitic capacitance, inductance, resistances, etc.) and non-ideal condition (e.g., processing related mismatch errors, noise, etc.). Ideally, the current sources ($I_{COMP_P}$ and $I_{COMP_N}$) are generated from the same type of resistors (e.g., same temperature coefficient, same thermal noise, same materials, etc.) as the resistor array. However, there is likely a mismatch between the current sources due to process imperfections, temperature based difference, as well as other non-ideal error sources.

The voltage between the $V_P$ and $V_N$ references can be designated as $V_{PN}$, which is dependent on the current sources $I_{COMP_P}$ and $I_{COMP_N}$, and the resistor array. Errors in the reference voltage due to mismatched currents can be given by: $\Delta V_{PN}=I_{error}*R_{PAR}/R_{array}$, where $I_{error}$ is the error in the current, $R_{PAR}$ is the total parasitic resistances (e.g., $R_{P1}$, $R_{P2}$), and $R_{array}$ is the total resistance of the resistor array. In one example design, $R_{array}$ is on the order of a few thousand Ohms and $R_{PAR}$ is the parasitic metal resistance from $V_{REFP}$ to $V_P$, which is on the order of a few hundred Ohms.

The resistor array reference voltage error may be on the order of micro voltage (μV), which is likely significantly smaller than the error caused by the resistor mismatch in the array. When the constant current is flowing through the resistor array without any connection between internal and external references, the voltage error outside of resistor array may be observed on the order of a few tens of milli-volts (mV)], which is not acceptable for a four bit per stage MDAC. The signal path from the references to the resistor array in the sub-ADC can be made by thin metal line as long as the time constant is small enough for fast settling. The larger parasitic resistance may be desirable in order to isolate noise from coupling between the noisy internal reference generator and the high speed references for the MDACs.

Figure 1B:
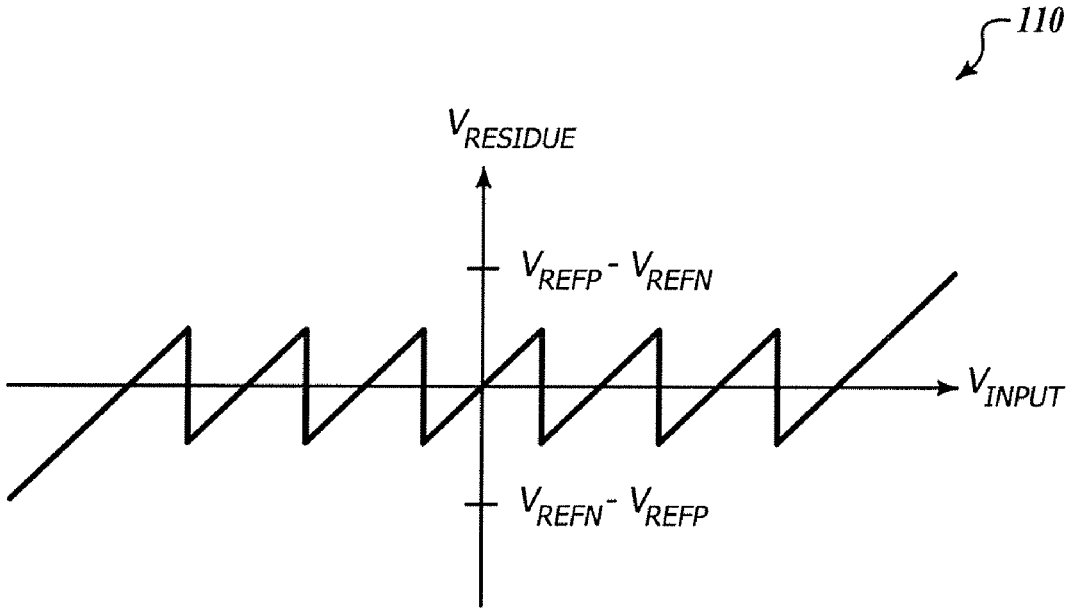
FIG. 1B (PRIOR ART)
FIG. 1B illustrates a graph of an ideal residue curve for a pipelined analog-to-digital converter (ADC).

The ideal residue curve for the MDAC was previously described with respect to FIG. 1B. The current compensation methods described herein are arranged to compensate for the non-ideal parasitic resistances and provide a residue curve that is substantially the same as ideal residue curve previously described.

Unity gain buffer amplifiers can be inserted between the pad areas and the reference voltage nodes ($V_P$, $V_N$) instead of using the described current compensation method. However, the resulting operating frequency of the entire ADC system will be significantly lower as a result of the limited bandwidth from the buffer amplifiers.

Example Control Circuit and Reference Circuit

Figure 4:
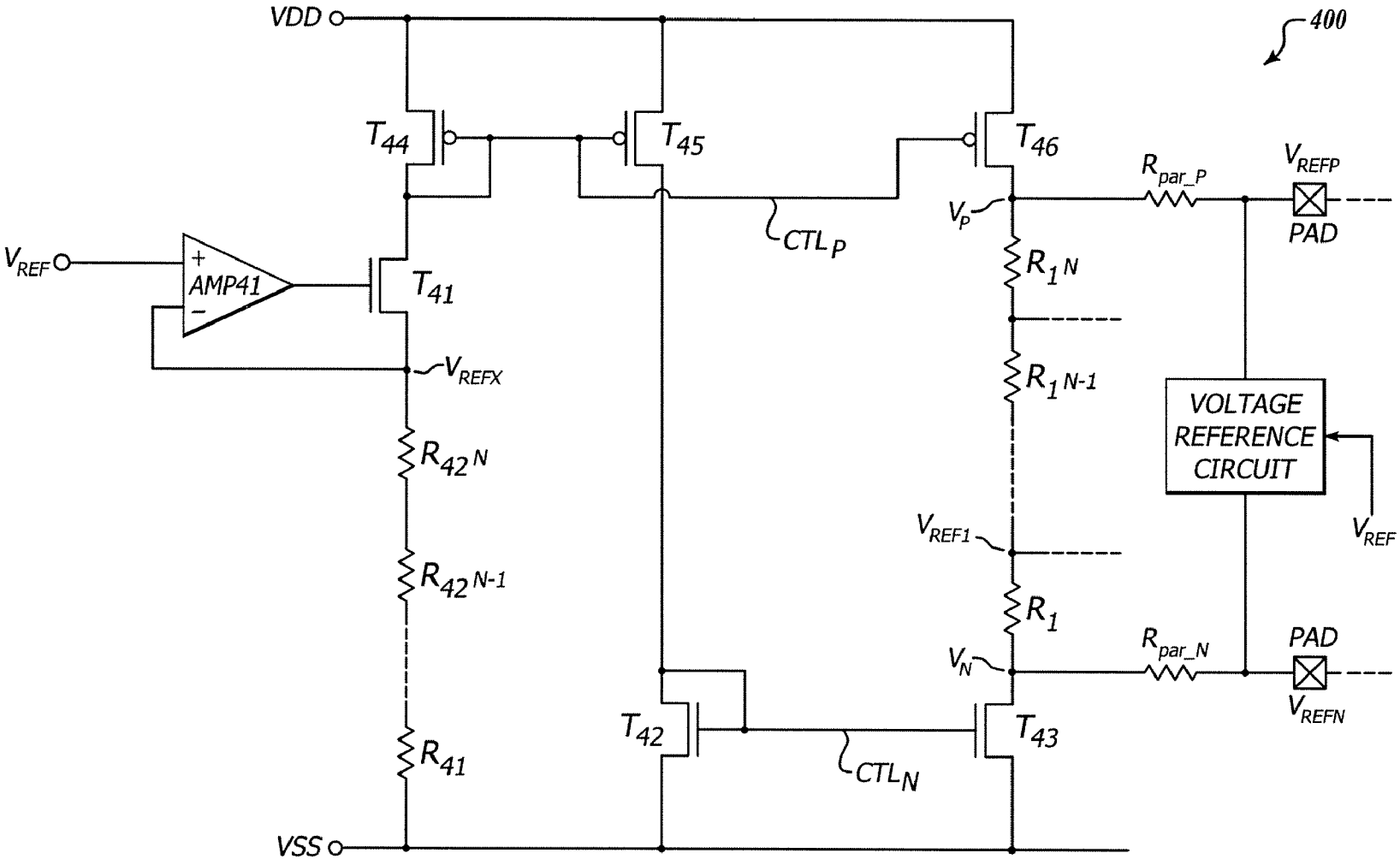
FIG. 4 is a schematic diagram of a control circuit and a reference voltage generator circuit that is arranged in accordance with at least one aspect of the present disclosure.

FIG. 4 is a schematic diagram of a control circuit and reference voltage generator circuit (400) that is arranged in accordance with at least one aspect of the present disclosure. The circuit (400) is arranged to provide control to the current sources that are coupled to the resistor array (e.g., see FIG. 3). The circuit includes a differential amplifier circuit (AMP41), four transistors ($T_{41}$, $T_{42}$, $T_{44}$, $T_{45}$), and a voltage divider resistor array ($R_{41}$–$R_{42}^N$). Transistors $T_{43}$ and $T_{46}$ are example implementations for current sources $I_{COMP_N}$ and $I_{COPM_P}$, respectively.

Amplifier AMP41 includes a non-inverting input that is coupled to a reference voltage ($V_{REF}$), a non-inverting input that is coupled to the source of transistor $T_{51}$, and an output that is coupled to the gate of transistor $T_{41}$. The drain of transistor $T_{41}$ is coupled to the gate and drain of transistor $T_{44}$, which is arranged in a current-mirror configuration with transistor $T_{45}$. The gate of transistor $T_{44}$ is arranged to provide the first control signal ($CTL_P$) to the gate of transistor $T_{46}$, which is responsive thereto. Transistor $T_{42}$ has a gate and drain that are coupled together to the drain of transistor $T_{45}$, and is arranged to provide the second control signal ($CTL_N$). The resistor array ($R_{41}$–$R_{42}^N$) is coupled between the source of transistor $T_{41}$ and a power supply terminal (e.g., $V_{SS}$) or signal ground (GND).

The resistor array formed by resistors $R_{41}$–$R_{42}^N$ is matched in performance of the other resistor array formed by resistors $R_1$–$R_2^N$. In operation AMP41 is arranged to adjust the internal reference voltage ($V_{REFX}$) across the resistor array ($R_{41}$–$R_{42}^N$) until it is substantially equal to $V_{REF}$. The current flowing through one resistor array ($R_{41}$–$R_{42}^N$) is substantially matched (or alternatively precisely scaled) to the current flowing through the other resistor array ($R_1$–$R_2^N$).

The internal reference voltages made from the resistor arrays should be accurate enough for the high resolution per-stage pipeline ADC to put more offset margin on the comparator design and the settling time of the internal reference voltages must be short enough for the high speed operation. Smaller comparator offset including device mismatch and internal reference voltage error reduces the ADC linearity error, which is directly related to the harmonic distortion. This novel invention reduces the internal voltage error level much less than the device mismatch level and also fast settling is achieved with connecting the internal references to the original references, which is bypassed by big external capacitor, for the MDACs. The die area can be saved with thin metal lines for connecting two references between internal and external instead of using wide metal.

The presently disclosed reference voltage circuits can be used for the internal reference voltage generation in a multi-bit sub-ADC (e.g., a 4 bit design). However, the concepts of the present disclosure can be used in broad range of areas beyond internal reference voltages such as any IR voltage drop circuit that requires compensation from parasitic or unwanted resistances in the signal path.

Although the invention has been described herein by way of exemplary embodiments, variations in the structures and methods described herein may be made without departing from the spirit and scope of the present disclosure. For example, the positioning of the various components may be varied. Individual components and arrangements of components may be substituted as known to the art. Circuit functions can be combined and/or separated into additional parts as may be desired for certain implementations. Since many embodiments of the invention can be made without departing from the spirit and scope of the invention, the invention is not limited except as by the appended claims.

What is claimed is:

1. An apparatus for generating a stable voltage reference from a reference voltage ($V_{REF}$), the apparatus comprising:

a parasitic resistance that is coupled between a first node and a second node;

a first resistance circuit that is coupled between the second node and a third node, wherein the third node is associated with a signal ground;

a voltage reference circuit that is arranged to provide a first input reference voltage ($V_{REFP}$) to the first node and a second input reference voltage ($V_{REFN}$) to the third node such that the difference between the first input reference voltage ($V_{REFP}$) and the second input reference voltage ($V_{REFN}$) is responsive to the reference voltage ($V_{REF}$);

a control circuit that is arranged to provide a first control signal ($CTL_P$) such that: the first control signal ($CTL_P$) is responsive to changes from the reference voltage ($V_{REF}$), wherein the control circuit includes a second resistance circuit that is arranged such that a voltage across the second resistance circuit is substantially equal to the reference voltage ($V_{REF}$), and arranged such that the first control signal ($CTL_P$) is responsive to changes in operational characteristics of the second resistance circuit and changes in the reference voltage ($V_{REF}$; and a first controlled current source ($I_{COM_P}$) that is coupled between a power supply terminal and the second node, wherein the first controlled current source ($I_{COMP_P}$) is responsive to the first control signal ($CTL_P$) such that the voltage drop across the first resistance circuit is maintained, wherein the effect of the parasitic resistance is mitigated by operating the first controlled current source ($I_{COMP_P}$) in an open loop configuration with respect to the first input reference voltage ($V_{REFP}$).

2. The apparatus of claim 1, wherein the parasitic resistance comprises at least one member of a group comprising: a metal trace in a circuit board, a metal trace in an integrated circuit, a poly-silicon trace in an integrated circuit, a conductor that is in electrical communication between the first node and the second node, a conductive bonding pad, a wire bond, and a package lead-frame.

3. The apparatus of claim 1, the first resistance circuit comprising at least one member of a group comprising: a first resistor that is series coupled to a second resistor between the second node and the third node, and an array of resistors that are series coupled between the second node and the third node.

4. The apparatus of claim 1, wherein the voltage reference circuit includes at least one member of a group comprising: a band-gap reference, a regulated voltage reference, a high-speed voltage reference, and a filter capacitor.

5. The apparatus of claim 1, wherein the control circuit is arranged to replicate the operational characteristics of the first resistance circuit with the second resistance circuit.

6. The apparatus of claim 1, wherein: the first resistance circuit comprises a first array of resistors that are arranged in series with one another, the second resistance circuit in the control circuit comprises a second array of resistors that are arranged in series with one another, and the first array of resistors has matched operational characteristics with the second array of resistors.

7. The apparatus of claim 6, wherein each resistor of the first array of resistors and the second array of resistors are matched to one another and arranged in a common area of an integrated circuit such that the matched operational characteristics are provided.

8. The apparatus of claim 6, wherein each resistor of the first array of resistors is ratio matched to each resistor of the second array of resistors such that the matched operational characteristics are provided.

9. The apparatus of claim 1, further comprising:

a second parasitic resistance that is coupled between a fourth node and the third node; and a second controlled current source ($I_{COMP_N}$) that is coupled between the third node and the signal ground such that the third node is coupled to the circuit ground through the second controlled current source ($I_{COMP_N}$), wherein the second controlled current source ($I_{COMP_N}$) is responsive to a second control signal ($CTL_N$) such that the voltage drop across the first resistance circuit is maintained, wherein the voltage reference circuit is arranged to provide the second input reference voltage ($V_{REFN}$) to the third node through the second parasitic resistance via the fourth node, and wherein the control circuit is arranged to provide the second control signal ($CTL_N$) such that the second control signal ($CTL_N$) is responsive to changes from the reference voltage ($V_{REF}$).

10. The apparatus of claim 9, wherein the voltage reference circuit is arranged to provide the first input reference voltage ($V_{REFP}$) and the second input reference voltage ($V_{REFN}$) as a controlled voltage drop across the second node and the third node, and wherein the control circuit is arranged to control the first controlled current source ($I_{COMP_P}$) and the second controlled current source ($I_{COMP_N}$) such that the voltage drop is maintained.

11. An apparatus for generating a stable voltage reference from a reference voltage ($V_{REF}$), the apparatus comprising:

a voltage reference circuit that is arranged to provide a first note reference voltage ($V_{REFP}$) a first node and a second input reference voltage ($V_{REFN}$) to a second node in response to the reference voltage ($V_{REF}$);

a first parasitic resistance that is coupled between the first node and a third node;

a second parasitic resistance that is coupled between the second node and a fourth node;

a first resistor array circuit that is coupled between the third node and the fourth node;

a second resistor array circuit that is coupled between a fifth node and a sixth node, wherein the first resistor array circuit is matched in operational performance with the second resistor array circuit;

a first amplifier circuit that is arranged to adjust an internal control signal in response to a comparison between an internal reference voltage ($V_{REFX}$) and the reference voltage ($V_{REF}$);

a first transistor circuit that is arranged to control a current flow through the second resistor array circuit in response to the internal control signal such that the internal reference signal is generated as a voltage across the second resistor array;

a second transistor circuit that is arranged to provide a first control signal and a second control signal in response to the current flow through the second resistor array circuit;

a first controlled current source ($I_{COMP_P}$) that is arranged to provide a first current to the third node in response to the first control signal ($CTL_P$); and a second controlled current source ($I_{COMP_N}$) that is arranged to provide a second current to the fourth node in response to the second control signal ($CTL_N$), wherein the first and second controlled current sources ($I_{COM_P}$, $I_{COMP_N}$) are arranged in cooperation with the voltage reference circuit and the first resistor array circuit to maintain a substantially constant voltage drop across the first resistor array circuit.

12. The apparatus of claim 11, the voltage reference circuit comprising:

a differential amplifier circuit that includes: a first output that is coupled to the first node, a second output that is coupled to the second node, a first input that is coupled to a seventh node, and a second input that is coupled to an eighth node;

a first resistor circuit that is coupled between the first node and the seventh node;

a second resistor circuit that is coupled between the second node and the eighth node;

a third resistor circuit that is coupled between the seventh node and the input reference signal; and a fourth resistor circuit that is coupled between the eighth node and a power supply terminal.

13. The apparatus of claim 11, wherein the first resistor array circuit comprises a plurality of unit-sized resistors that are arranged in series with one another; wherein the junction between each of the unit sized resistors corresponds to a different reference voltage level.

14. The apparatus of claim 11, wherein the first resistor array circuit and the second resistor array circuit are each arranged as a plurality of unit-sized resistors that are arranged in series with one another, such that the first resistor array circuit is matched to the second resistor array circuit.

15. The apparatus of claim 11, wherein the first transistor circuit includes a field effect transistor that is responsive to the internal control signal.

16. The apparatus of claim 11, wherein the first transistor circuit comprises a first transistor, and the second transistor circuit comprises a second transistor, wherein: the first transistor is responsive to the internal control signal to adjust the current flow through the second resistor array circuit, the second transistor is configured as a diode circuit that is arranged to provide a sense voltage in response to the current flow through the second resistor array circuit.

17. The apparatus of claim 16, the second transistor circuit further comprising a current mirror circuit that is responsive to the sense voltage, and arranged to provide either the first control signal or the second control signals.

18. The apparatus of claim 16, the second transistor circuit further comprising a first current mirror circuit that is responsive to the sense voltage and arranged to provide the first control signal; and a second current mirror circuit that is responsive to the sense voltage and arranged to provide the second control signal.

19. An apparatus for generating a stable voltage reference from a reference voltage ($V_{REF}$), the apparatus comprising:

a means for generating a first difference voltage between a first node and a second node in response to the reference voltage ($V_{REF}$);

a means for coupling the first node to a third node;

a means for coupling the second node to a fourth node;

a first resistor means that is coupled between the third node and the fourth node;

a first controlled current means that is arranged to provide a first controlled current to the third node in response to a first control signal;

a second controlled current means that is arranged to provide a second controlled current to the fourth node in response to a second control signal;

a second resistor means that is coupled between a fifth node and a sixth node, wherein the operational characteristics of the second resistor means is matched to the first resistor means;

a first control means that is arranged to: maintain second difference voltage between the fifth node and the sixth node in response to the reference voltage ($V_{REF}$); and a current sense means that is arranged to sense a current flow in the second resistor means and generate the first control signal and the second control signal.

20. A method for generating a plurality of stable reference voltages from a reference voltage ($V_{REF}$), the method comprising:

generating a first difference voltage between a first node and a second node in response to the reference voltage ($V_{REF}$);

coupling the first node to a third node;

coupling the second node to a fourth node;

coupling a first current to the third node in response to a first control signal;

coupling a second current to the fourth node in response to a second control signal;

setting the plurality of stable reference voltages with a first resistor array that is coupled between the third node and the fourth node;

controlling a second difference voltage across a second resistor array such that the second difference voltage is substantially the same as the first difference voltage;

sensing a current flow in the second resistor array;

adjusting the first and second control signals in response to the sensed current flow; and adjusting the plurality of stable reference voltages in response to the first and second control signals.

* * * * *

UNITED STATES PATENT AND TRADEMARK OFFICE

CERTIFICATE OF CORRECTION

PATENT NO. : 7,279,960 B1
APPLICATION NO. : 11/215174
DATED : October 9, 2007
INVENTOR(S) : Bumha Lee It is certified that error appears in the above-identified patent and that said Letters Patent is hereby corrected as shown below:

Column 3, line 49: "comparators ($COMP_1$ … $COMP_{2-1}^{N}$)" should read -- comparators ($COMP_1$ … $COMP_2^{N}$- $_1$) --

Column 4, line 66: "$V_{STEP-NON-IDEAL}$-" should read -- $V_{STEP-NON-IDEAL}$= --

Column 5, line 10: "($V_{REFP}$ - $V_{REFN}$)" should read -- ($V_{REFP}$ - $V_{REFN}$) * --

Column 5, line 30: "resistor ($R$-$R_1$-$R_2^{N}$)" should read -- resistor $R$=$R_1$=$R_2^{N}$ --

Column 6, line 26: "circuit $COMP_{2-1}^{N}$" should read -- circuit $COMP_2^{N}$- $_1$ --

Column 6, line 28: "and $R_{2-1}^{N}$" should read -- and $R_2^{N}$ $_{-1}$ --

Column 10, line 16: "first note reference" should read -- first input reference --

Signed and Sealed this

Eighteenth Day of March, 2008

JON W. DUDAS
*Director of the United States Patent and Trademark Office*